US009671754B2

(12) United States Patent
Streubel et al.

(10) Patent No.: US 9,671,754 B2
(45) Date of Patent: Jun. 6, 2017

(54) BARREL WITH SUBSTANTIALLY CONSTANT TORQUE

(71) Applicant: Glashuetter Uhrenbetrieb GmbH, Glashuette/Sachsen (DE)

(72) Inventors: Patrick Streubel, Glashuette (DE); Silko Goldmann, Duerroehrsdorf (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 0 days.

(21) Appl. No.: 15/058,777

(22) Filed: Mar. 2, 2016

(65) Prior Publication Data

US 2016/0274540 A1 Sep. 22, 2016

(30) Foreign Application Priority Data

Mar. 18, 2015 (EP) ..... 15159696

(51) Int. Cl.

| | |
|---|---|
| ***G04B 1/10*** | (2006.01) |
| ***G04B 1/16*** | (2006.01) |
| ***G04B 1/20*** | (2006.01) |
| ***G04B 5/00*** | (2006.01) |
| ***G04B 9/00*** | (2006.01) |
| ***G04B 1/22*** | (2006.01) |

(52) U.S. Cl.

CPC ..... *G04B 1/16* (2013.01); *G04B 1/10* (2013.01); *G04B 1/20* (2013.01); *G04B 1/225* (2013.01); *G04B 5/002* (2013.01); *G04B 9/00* (2013.01)

(58) Field of Classification Search

CPC ... G04B 1/10; G04B 1/16; G04B 1/22; G04B 9/00; G04B 9/02; G04B 1/20; G04B 1/225; G04B 5/00; G04B 5/02

See application file for complete search history.

(56) References Cited

U.S. PATENT DOCUMENTS

| | | | | |
|---|---|---|---|---|
| 3,787,673 | A * | 1/1974 | Watson | G06F 9/3885 708/521 |
| 6,439,762 | B2 * | 8/2002 | Hara | G04B 1/22 360/112 |
| 7,780,342 | B2 * | 8/2010 | Takahashi | G04B 1/10 368/140 |

FOREIGN PATENT DOCUMENTS

| | | |
|---|---|---|
| CH | 10 576 | 1/1896 |
| CH | 365 670 | 11/1962 |
| CH | 381 158 | 4/1964 |
| FR | 1 145 972 | 11/1957 |
| WO | WO 2012/168443 A2 | 12/2012 |

OTHER PUBLICATIONS

European Search Report issued Nov. 16, 2015 in European application 15159696.2, filed on Mar. 18, 2015(with English Translation and Written Opinion).

* cited by examiner

*Primary Examiner* — Vit W Miska

(74) *Attorney, Agent, or Firm* — Oblon, McClelland, Maier & Neustadt, L.L.P.

(57) ABSTRACT

A barrel for a timepiece. The barrel has a device for limiting the number of running rotations of the barrel, wherein this device still allows any number of winding rotations of the barrel.

20 Claims, 3 Drawing Sheets

BARREL WITH SUBSTANTIALLY CONSTANT TORQUE

Figure 1A:
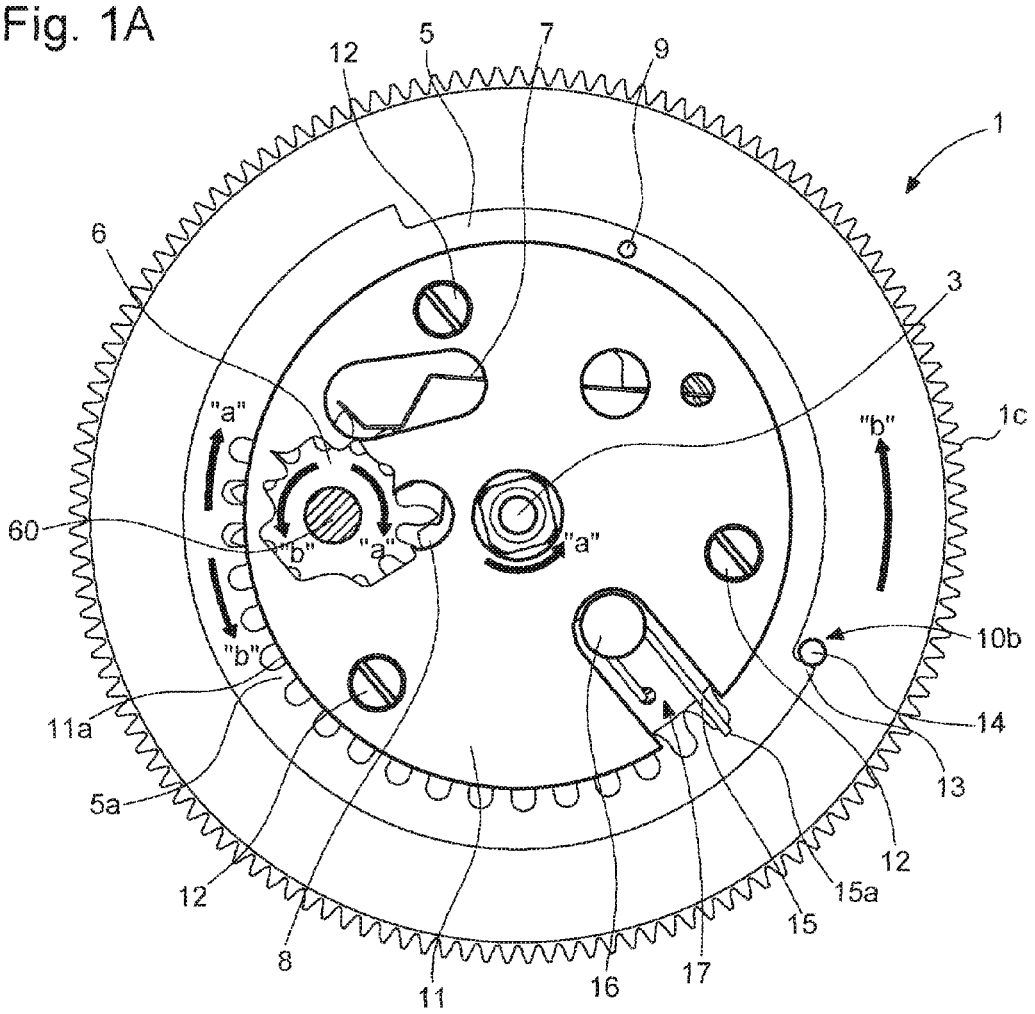

This application claims priority from European Patent Application No. 15159696.2 filed Mar. 18, 2015, the entire disclosure of which is hereby incorporated herein by reference.

The present invention relates to a barrel that is adapted, amongst other things, for an automatic winder, and allows therein only a limited number of running rotations.

In timepieces which are not fitted with an automatic winder, i.e. hand winders, so-called Maltese cross positioners are used to limit the number of rotations of the spring core and of the barrel drum during the winding up or during the running. In patent document CH10576, such a barrel structure is shown where the Maltese cross has a so-called locking tooth. The number of winding rotations and of running rotations has been set to the same predetermined number—here 5.

So-called gear settings are also used for this purpose, e.g. the Breguet locking mechanism that has two wheels, each of which has a certain projection on a superimposed placement plane and meet and mutually block each other after a number of running or winding rotations—four as a rule.

In contrast to the barrels of hand-wound watches, the barrels of timepieces with automatic winders have no limit on the number of winder rotations. In hand-wound watches, this limit is achieved by fixing the mainspring by means of a hook to the inner wall of the barrel; the mainsprings of movements with an automatic winder have in contrast a so-called slipping bridle at their outer end, which allows a sliding of the mainspring at the inner wall of the barrel when a certain torque is exceeded.

Such timepieces with automatic winder are however not fitted with the above-mentioned locking devices, i.e. the number of running rotations of the barrel is not limited. A disadvantage of these timepieces is therefore that no minimum torque level is ensured when running. Namely as is well-known, the mainspring torque of a timepiece diminishes as it approaches the end of the number of possible rotations and the movement precision of the time piece becomes worse, especially at the end of the overall power reserve. The activation or placement of certain functions that require a great deal of drive power can therefore also be interfered with.

The object of the present invention is to overcome these disadvantages.

Starting from the preamble of claim 1, this object is achieved by the characterising features of claim 1.

The barrel according to the present invention that has a device for the limiting of the number of running rotations but however allows any number of winder rotations of the barrel, allows on the one hand the number of winder rotations to be decoupled from the running rotations of the barrel. In this, the degree of mainspring winding in a barrel for an automatic winder is still restricted by the slipping bridle and at the same time the available torque is maintained at an adequate level. This decoupling of the number of winder rotations and of running rotations of the barrel is also advantageous for a manual winder with a mainspring attached to the inner wall of the barrel by a hook if, for example, a second barrel with a different torque and different number of winder and running rotations of the main spring compared with those in the first barrel, is to be wound up by the same rotational movement of a winding crown.

Limiting the number of running rotations of the barrel means that fewer windings of the mainspring than that possible are used to drive the timepiece. The windings of the mainspring, which have a relaxed torque, are separated from the driving of the timepiece. This means that only an almost constant range of torque of the mainspring is used for driving the timepiece, wherein the available torque can be increased in comparison to that of an ordinary timepiece with conventional manual winding. The timepiece can therefore achieve a higher movement precision up to the end of its reduced power reserve. A further advantage is that, at the end of the overall power reserve, there is still sufficient torque available in the mainspring to let additional functions of the timepiece—the date, for example, reliably go. A striking mechanism could for example also be released without having to take the risk of being stopped undesirably because of a lack of driving power.

This means that not only is the precision of the timepiece improved, but also the reliability of all existing functions that are driven or released from the barrel.

According to G. A. Berner, "Dictionnaire professionnel illustré d'horlogerie", pp. 60-62, Object 256 "Arretage (stopwork)", the average watchmaker should supposedly not have been using any locking devices for a long time now. On the other hand, attempts are now being made to increase the overall power reserve of timepieces—especially timepieces with an automatic winder—which distracts considerably from the suggested running limiter device for a barrel as the power reserve of the barrel is, on the contrary, reduced by that. The claimed barrel thereby solves a problem that has also existed for a long time, namely how hand winders fitted with a stopwork are also to be separated in the case of a barrel for a timepiece with automatic winder, to limit the effective length of the mainspring and so the separate off the relaxed torque of the mainspring at the end of the power reserve from the overall power reserve.

Advantageous embodiments of the invention are described in the dependent claims and in the description below.

In the following, the preferred embodiment of the invention is described—with reference to the accompanying figures.

Figure 1B:
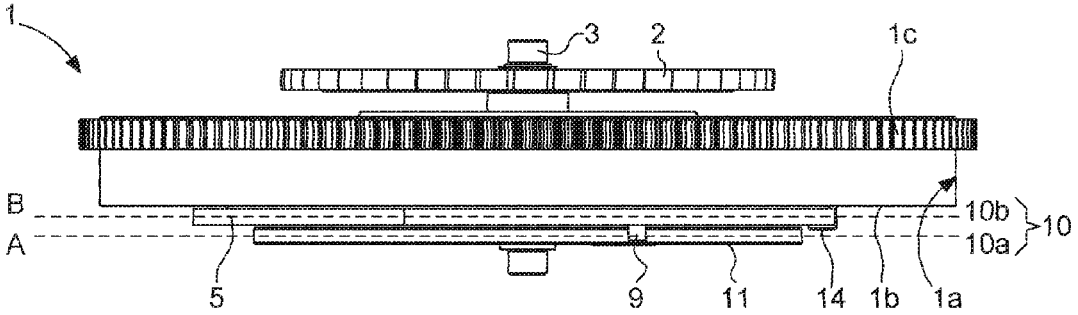

The individual figures show in detail:

FIGS. 1A and 1B: show respectively a view from below and from the side of a barrel fitted with the claimed device.

Figure 2:
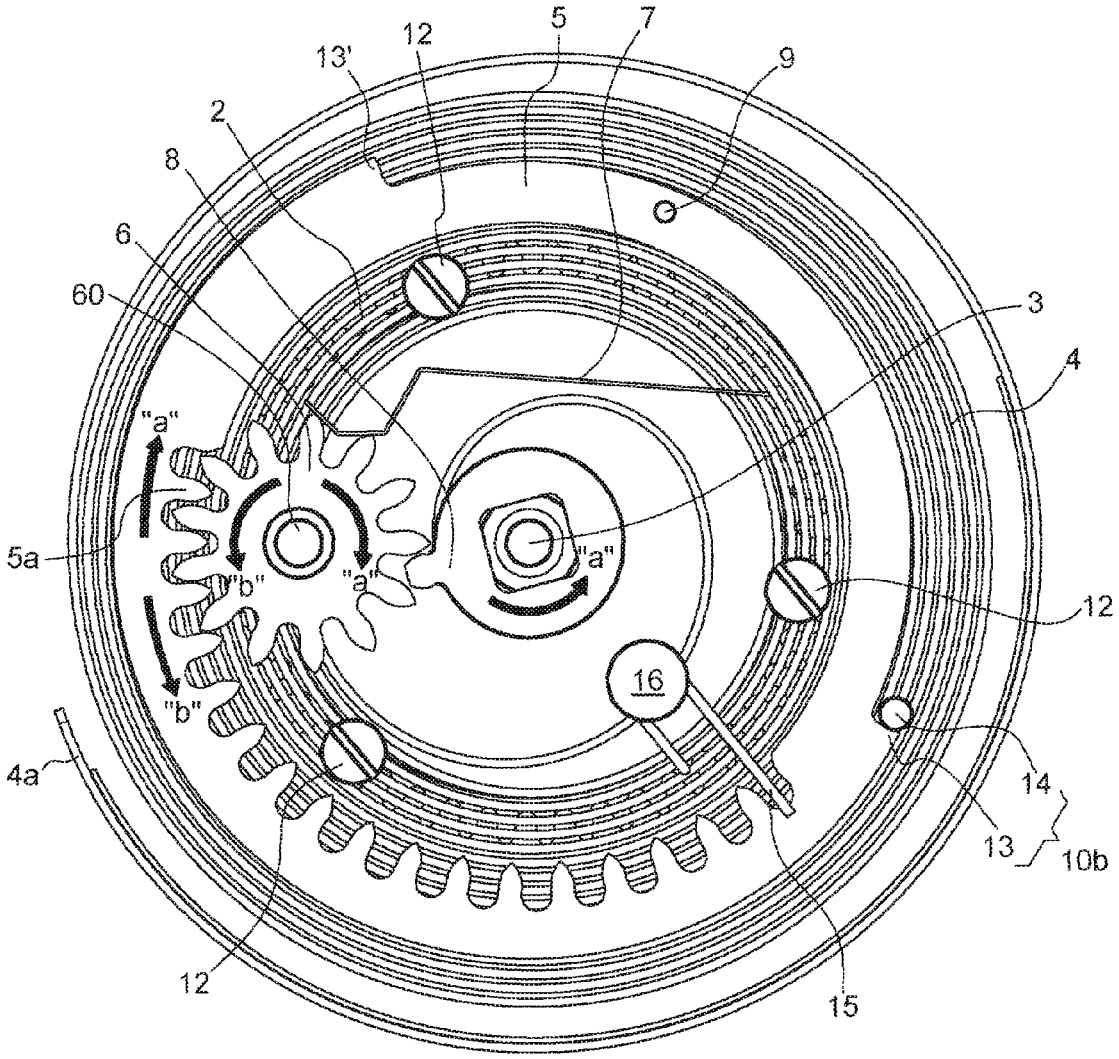

FIG. 2: a modified view from below where, in contrast to FIG. 1 B, neither the cover plate nor the barrel is shown.

Figure 3A:
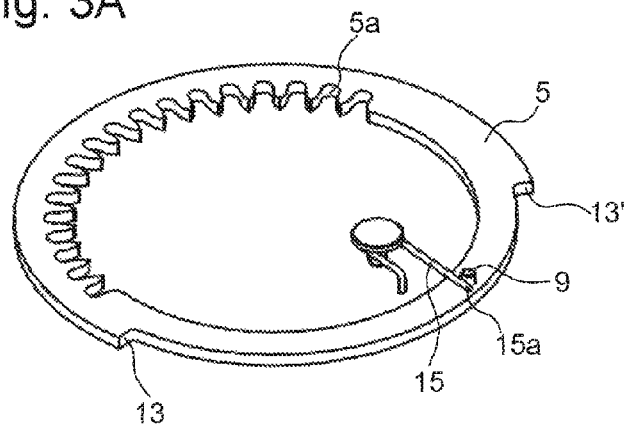
Figure 3B:
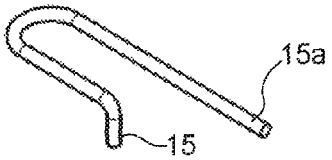

FIGS. 3A and 3B each show a detailed perspective view of the positioning ring and of the return spring (from below).

Figure 4A:
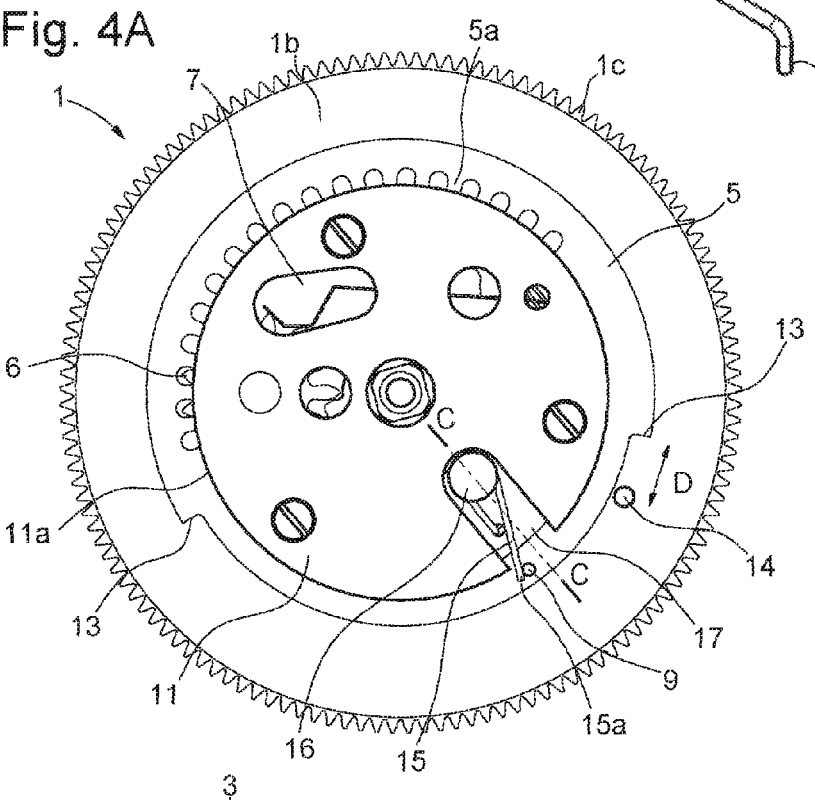
Figure 4B:
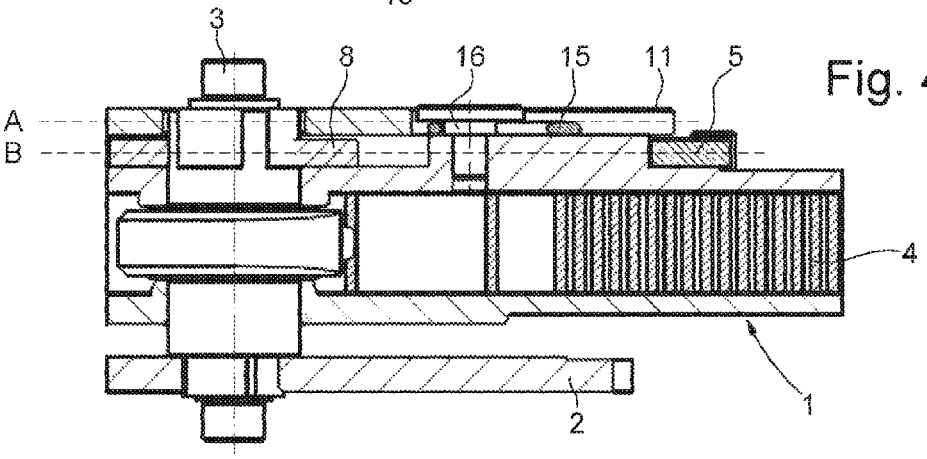

FIGS. 4A and 4B: a view from below and a sagittal sectional view of the barrel with illustration of the first device for the release of the winding rotations during the winding.

In the following, simultaneous reference is made to the FIGS. 1A, 1B and 2 which show various views of the barrel 1 of a timepiece with an automatic winder according to a preferred embodiment of the invention. In particular, in FIGS. 1A and 2, the device for the limiting of the running rotations is emphasised in that the barrel 1 is shown in a blocking position.

An ordinary barrel 1 is available for a timepiece with automatic winder. Locking wheel 2 on spring shaft 3 is located on the upper side. Turning the locking wheel 2 (first arrow direction "a") to the left winds the mainspring 4. As soon as the spring 4 is completely wound around the spring shaft 3, the slipping bridle 4*a* of the mainspring slips along the drum inner wall 1*a* of the barrel 1. During the running, the barrel 1 also turns to the left (second arrow direction "b"), during which the spring shaft 3 is stationary. With that, the driving tooth system 1*c* drives the movement and any other connected modules, e.g. the calendar circuit.

The claimed device 10 is preferably step-shaped and located under the base 1*b* of the barrel 1. On the one hand, it is hidden on the workplate after fitting and more easily accessible when assembling as it is not partially hidden by the locking wheel 2. As shown in FIG. 1B, the claimed device 10 comprises preferably two separate devices, each of which is intended for a particular function; namely, a first device 10*a* for the release of wind rotations and the second device 10*b* for the limiting of the number of running rotations of the barrel 1. The first device 10*a* works in a first placement plane A and the said second device 10*b* works in a second, separate placement plane B so that each desired function can be performed in a corresponding, dedicated placement plane, so that the additional modules can be set up step-by-step without having any effect on the normal drum-locking wheel structure of the barrel.

The device 10, according to the preferred embodiment of the invention, contains one positioning ring 5 rotatably mounted on the barrel 1, the said ring also being illustrated in detail in FIG. 3A, and is involved both in the first device 10*a* and the second device 10*b*. This positioning ring 5 is stacked between the base 1*b* of the barrel 1 and an added cover plate 11 and seated on a shoulder that is not shown (e.g. vertical, cylindrical wall sections on the underside of the barrel 1). The cover plate 11 that is arranged as a deeper, double base for the barrel 1, is preferably fixed to barrel 1 using the screws 12—for example three as shown in FIGS. 1A and 2—and has preferably a cutout 17 in order to fix a return spring 15 to the barrel 1 by means of a shoulder pin, the said return spring 15 interacting with the first pin 9 during winding up. The return spring 15 and the first pin 9 form one preferred embodiment for the first device 10*a* for the release of the winding rotations. As shown in FIG. 1B, this first device 10*a* works in the first placement plane A, and its precise functioning is explained in more detail with the aid of the FIGS. 4A-4B.

As shown in FIGS. 1A, 2 and 3A, the positioning ring 5 has an inner set of toothing 5*a* that meshes with a gearwheel 6 and has at its outside edge a divergence between a first locating surface 13 and a second locating surface 13'. The said divergence simply forms a circular section whose radius is smaller than that of the remaining circular edge. The two locating surfaces—that is the first locating surface 13 and the second one 13'—are so formed. The interaction of a second pin 14 with the first locating surface 13 forms in a similar way a preferred embodiment for the second device 10*b* that works in the second placement plane B. In FIGS. 1A and 2, the barrel 1 is shown in an already locked position as the second pin 14 is supported on the locating surface 13 and a further running in the second arrow direction "b" is blocked.

The positioning ring 5 shown in FIGS. 1A, 2 and 3A has an inner toothing 5*a* with a total of 17 teeth which defines the maximum number of running rotations. These inner toothing 5*a* meshes with a gearwheel 6 that has 13 teeth and the latter, in turn, engages with a placement finger 8 on the other side. This means that the positioning ring 5 can be indexed by one tooth to the right or left, either during the winding up of the barrel 1 (first arrow direction "a" for the entire gear chain placement finger 8-gearwheel 6-positioning ring 5) or in the opposite direction during the running of the barrel (second arrow direction "b" for the gear train barrel 1-gearwheel 6-positioning ring 5). In the position of the positioning ring 5 shown in FIGS. 1A, 2, it can be seen that no further shifting of the positioning ring 5 to the right in arrow direction "b" is possible, not only because the second pin 14 on the barrel 1 hits the first locating surface 13 but because there is no further tooth on the left side of the inner toothing 5*a*.

According to the preferred, illustrated embodiment, the divergence between the first locating face 13 and the second locating face 13' is symmetrically arranged relative to the inner toothing 5*a*, i.e. this divergence extends over an angular section of the same value such as the inner toothing 5*a* of the positioning ring 5 so that the second pin 14 would hit the opposing second locating surface 13' in a similar way in the winding up direction (as in first arrow direction "a"), if the gearwheel 6 would engage with the last right tooth of the inner toothing 5*a*. This therefore ensures a dual protection for the rotational lock in both directions; this last lock is however never used thanks to the arrangement of the first pin 9 in the angular sector between the two locating surfaces (13 and 13') because the first device 10*a* is always actuated first.

To improve the reliability of the device 10 relative to the placement of the rotational position of the rotatable positioning ring 5 mounted on the barrel 1, an indexing mechanism also exists that is made in the preferred embodiment by a detent spring 7 that engages between the meshing teeth of the gearwheel 6. This mechanism works in the second placement plane B, i.e. directly in the plane of the positioning ring 5, and therefore does not intrude into the inner space of the barrel. Such a compact arrangement outside the barrel 1 does not therefore disturb its normal operation and requires hardly any additional space that could be used for other parts in the timepiece.

FIGS. 3A and 3B show a preferred embodiment for the positioning ring 5 and the return spring 15 where the return spring 15 has approximately a U-shape and is such arranged that it is attached to the barrel 1 with a shoulder pin 16. The return spring 15 has a longer arm fitted with a tip 15*a* which forms a part of this spring component that protrudes beyond the edge of the cover plate 11 (see, for example, FIG. 1A) and can interact with the first pin 9 attached to the positioning ring 5. Such an arrangement allows the restoring force of the spring tip 15*a* to be maximised. The first pin 9 lies at an angle between the first locating surface 13 and the second locating surface 13' so that this pin 9 hits the return spring 15 when the barrel 1 is wound up, before the second pin 14 is blocked by the second locating surface 13' as a minimum distance D exists between the second pin 14 and the second locating surface 13' when winding up. This minimum distance D is shown in FIG. 4A and is also reached in that the angle between the return spring 15 and the second locating surface 13' is greater than the angle between the two locating surfaces (in each case, the first locating surface 13 and the second locating surface 13'), i.e. if the return spring 15 in the running blocked position of the barrel 1 sits behind the second pin 14 in the running direction (in the second arrow direction "b") as shown in FIG. 1A. In the next paragraph, the winding up operation is explained in detail for the barrel 1 that is fitted with the invention-related device 10, in that reference is made both at the beginning of the winding up in FIGS. 1A and 2 and in FIGS. 4A and 4B at the end of the winding up where the first device 10*a* is used for the release of the winding up rotations.

As illustrated in FIGS. 1A and 2, the positioning ring 5 is located on the underside of the barrel 1 and seated on a shoulder concentric with barrel 1. The said ring meshes with a gearwheel 6 whose rotary axis 60 is preferably located on the barrel drum in order to facilitate the fitting of the module. The gearwheel 6 is held at a defined indexed position by detent spring 7. The placement finger 8 is supported on the square section of the spring shaft 3. The axial support of gearwheel 6 and placement finger 8 is achieved using the cover plate 11, which is fixed to the barrel 1 by the screws 12. According to an alternative embodiment, the rotary axis 60 of the gearwheel 6 is also attached to this plate. This placement finger 8 performs each movement just like the spring shaft 3. After each complete rotation of spring shaft 3 and placement finger 8 in the arrow direction "a", the gearwheel 6 is rotated further by one index position; at the same time, this ring is rotated further by one position in the first arrow direction "a", i.e. the winding direction, defined by the tooth-meshing between gearwheel 6 and positioning ring 5. The position shown in FIGS. 1A and 2 is actually the last left tooth of the inner toothing 5*a* in the meshing with the wheel 6 so that the positioning ring 5 can only turn in the winding direction; the first locating surface 13 would be blocked anyway in the opposite arrow direction "b" (i.e. time running direction) by the second pin 14 attached to the base 1*b* of the barrel 1. The winding operation can therefore be started in this position.

With the number of rotational movements of the positioning ring 5 dependent on the gearing ratio between gearwheel 6 and the positioning ring 5, the pin 9 firmly fixed to the positioning ring 5 reaches the long spring arm of the return spring 15, or more precisely, the tip 15*a* of this long arm, which protrudes from the outer edge 11*a* of the cover plate 11. With a further turning of the spring shaft 3, the index finger 8 attempts to further switch the positioning ring 5. In this, the long spring arm of the return spring 15 is tensioned by the pin 9 on the positioning ring 5, as illustrated in FIG. 4A. In the position shown, the barrel 1 has not rotated in comparison with FIG. 1A—both the second pin 14 and the cutout 17 are in the same rotational positions. On the other hand, it can be seen that the gearwheel 6, which is also at the same position as detent spring 7, is indexed in a certain position, but now with the last teeth on the opposite side engaging with the inner toothing 5*a*. The interaction of the first pin 9 with the return spring 15 forms a preferred variant of the first device 10*a* for the release of the winding up rotations.

Namely as soon as the placement finger 8 has left the meshing with the gearwheel 6, the return spring 15 can press back the positioning ring 5 by overcoming the spring force of the detent spring 7. Such a prerequisite is easily fulfilled thanks to the advantageous arrangement of the return spring 15, as it tries to maximise the restoring force.

After this operation, which can be repeated any number of times, the return spring 15 is again relaxed, wherein it however still remains in contact with the second pin 14 until the next rotation of the spring shaft 3. The mainspring 4 of the barrel 1 shown in FIG. 4B can therefore be further tensioned and is only restricted when the slipping bridle 4*a* of this mainspring 4 slips at the drum inner wall of the barrel 1, i.e. only when the maximum allowable torque is reached.

FIG. 3B shows a sagittal sectional view C-C of the barrel 1 that illustrates a tensioned mainspring 4 and the various placement planes for this preferred embodiment that is presented. Down at the bottom lies the locking wheel 2 that is torque-proof attached to the mainspring 3. The cover plate 11 is located at the uppermost level, the cutout 17 in the said plate for fixing the return spring 15 is shown—implemented here with the help of the shoulder pin 16. The level of the cover plate forms the first placement plane, wherein the return spring 15 which interacts with the first pin 9 (the pin 9 is not shown in this figure). As already mentioned, the second placement plane B containing the placement finger 8 and the fitted rotatable positioning ring 5, lies between the cover plate 11 and the barrel 1.

The barrel 1 can be turned back from the position shown in FIG. 4A during the running to the position in FIGS. 1A and 1B. Namely during the running, the barrel 1 rotates in the second arrow direction "b", i.e. in the running direction. The spring shaft 3 remains stationary during this. After one rotation of the barrel 1, the rotatable gearwheel 6 mounted on the barrel 1 reaches the placement finger 8. In this rotating movement, the gearwheel 6 is turned by the placement finger 8 though one index position in the arrow direction "b". At the same time, due to the gear meshing between gearwheel 6 and the positioning ring 5, this indexes further by one position in the second arrow direction "b".

This operation can be repeated so often till, due to the rotation of the positioning ring 5, the locating surface 13 on the positioning ring 5 reaches the second pin 14 that is firmly attached to the barrel 1. This blocks the rotational movement of the barrel 1 in the second arrow direction "b" relative to the spring shaft 3 and both the barrel and all members of the device 10 are located at the position shown in FIG. 1A.

Someone skilled in the art will however understand from this description that the subject matter of the present invention covers other variants for the claimed device 10, namely with parts other than a positioning ring 5, other types of pins and stops that are located in other placement planes, and possibly designed as single parts that are not necessarily fixed to these. It can be understood especially that the first device 10*a* for the release of winding up rotations can function with any spring-loaded stop, wherein the spring element does not have to be located on the barrel 1; for example a spring-loaded instead of a rigid pin could be attached to the positioning ring 5, or vice versa a rigid finger instead of the return spring 15 on the barrel 1. The maximum number of running rotations can be adjusted as required and the transmission ratios between all gearing elements can also be adapted as required. Other aspects such as various materials (not just steel), forms and expansion direction for the spring-loaded stop of the first device 10*a* are quite possible—without exceeding the scope of the invention.

Someone skilled in the art will also understand that the present invention is not only limited to timepieces with automatic winding, but can also be adapted to movements with hand winder. The maximum allowable winding in the mainspring is then determined by the fixing hook instead of being limited by the slipping bridle, but never affected by the claimed device.

The detailed, preferred embodiment mentioned is therefore only to be regarded as an example and should not be construed as a restriction on the interpretation of the claims.

LIST OF REFERENCE NUMBERS

1 barrel
1*a* inside wall of the drum
1*b* base
1*c* driving tooth system
2 locking wheel
3 spring shaft
4 mainspring
4*a* slipping bridle
5 positioning ring
5*a* inner toothing
6 gear wheel
60 rotational axis of the gear wheel
7 detent spring
8 placement finger

9 first pin
10 device for limiting the number of running rotations with any number of winder rotations
10*a* first device for the release of winder rotations
10*b* second device for the limiting of running rotations
11 cover plate
11*a* outer edge of the cover plate
12 screws
13 first locating surface
13*a* second locating surface
14 second pin
15 return spring
15*a* tip
16 shoulder pin
17 cutout (in cover plate)
a first arrow direction—winding direction of the barrel
b second arrow direction—running direction of the barrel
A first placement plane of the first pin 9
B second placement plane of the second pin 14
C-C section direction for FIG. 4B
D minimum distance between pin 14 and the second locating surface 13' during winding

What is claimed is:

1. A barrel for a timepiece, wherein said barrel comprises:
a device to limit a number of running rotations of the barrel, wherein
said device still allows any number of winding rotations of the barrel, and
an outer periphery of said device in a radial direction of the barrel is disposed radially inward with respect to an outer periphery of a mainspring of the barrel in the radial direction.

2. The barrel according to claim 1, wherein said device is made up of a first device to release the winding rotations and a second device to limit the number of running rotations of the barrel, wherein said first device works in a first placement plane and said second device works in a second, different placement plane.

3. The barrel according to claim 1, wherein said device comprises a rotatable positioning ring mounted on the barrel.

4. The barrel according to claim 3, wherein device further comprises an indexing mechanism to rotatably position said rotatably mounted positioning ring.

5. The barrel according to claim 4, wherein said indexing mechanism comprises a detent spring that lies between engaging teeth of a gearwheel, wherein said gearwheel is driven by a placement finger non-rotatably fixed to a spring shaft and meshes with an inner toothing of the positioning ring.

6. The barrel according to claim 3, wherein said rotatable positioning ring is fitted in a stack between a base of the barrel and a cover plate.

7. The barrel according to claim 3, wherein said positioning ring comprises inner toothing, which meshes with a gearwheel, wherein said gearwheel is driven by a placement finger non-rotatably fixed to a spring shaft and wherein said positioning ring presents a gap between a first locating surface and a second locating surface on its outer edge.

8. The barrel according to claim 3, wherein said positioning ring comprises a first pin, which interacts with a return spring in a placement plane in a winding direction when winding up the barrel.

9. The barrel according to claim 8, wherein said pin is located in a same angular section as a gap between a first locating surface and a second locating surface.

10. The barrel according to claim 8, wherein said return spring is U-shaped and is attached to the barrel with the aid of a shoulder pin.

11. The barrel according to claim 7, wherein said first locating surface of said positioning ring interacts with a second pin located on the barrel in a second placement plane in order block a motion of the barrel according to a predetermined number of running rotations in a running direction.

12. A barrel for a timepiece, wherein said barrel comprises:
a device to limit a number of running rotations of the barrel, wherein
said device still allows any number of winding rotations of the barrel,
said device comprises a rotatable positioning ring mounted on the barrel, and
said rotatable positioning ring is fitted in a stack between a base of the barrel and a cover plate.

13. The barrel according to claim 12, wherein said device is made up of a first device to release the winding rotations and a second device to limit the number of running rotations of the barrel, wherein said first device works in a first placement plane and said second device works in a second, different placement plane.

14. The barrel according to claim 12, wherein device further comprises an indexing mechanism to rotatably position said rotatably mounted positioning ring.

15. The barrel according to claim 12, wherein said positioning ring comprises inner toothing, which meshes with a gearwheel, wherein said gearwheel is driven by a placement finger non-rotatably fixed to a spring shaft and wherein said positioning ring presents a gap between a first locating surface and a second locating surface on its outer edge.

16. The barrel according to claim 12, wherein said positioning ring comprises a first pin, which interacts with a return spring in a placement plane in a winding direction when winding up the barrel.

17. A barrel for a timepiece, wherein said barrel comprises:
a device to limit a number of running rotations of the barrel, wherein
said device still allows any number of winding rotations of the barrel,
said device comprises a rotatable positioning ring mounted on the barrel, and
said positioning ring comprises a first pin, which interacts with a return spring in a placement plane in a winding direction when winding up the barrel.

18. The barrel according to claim 17, wherein said device is made up of a first device to release the winding rotations and a second device to limit the number of running rotations of the barrel, wherein said first device works in a first placement plane and said second device works in a second, different placement plane.

19. The barrel according to claim 17, wherein device further comprises an indexing mechanism to rotatably position said rotatably mounted positioning ring.

20. The barrel according to claim 17, wherein said positioning ring comprises inner toothing, which meshes with a gearwheel, wherein said gearwheel is driven by a placement finger non-rotatably fixed to a spring shaft and wherein said positioning ring presents a gap between a first locating surface and a second locating surface on its outer edge.

* * * * *